US006484004B1

(12) United States Patent
Schein et al.

(10) Patent No.: US 6,484,004 B1
(45) Date of Patent: Nov. 19, 2002

(54) METHOD AND APPARATUS FOR STABILIZING THE CHARGE-TO-MASS RATIO OF VARIOUS TONER COMPONENTS IN A MULTI-TONER TONE-ON-TONE ELECTROPHOTOGRAPHIC DEVICE

(75) Inventors: Larry B. Schein, San Jose, CA (US); Hung-Hsu Hsu, Costa Mesa, CA (US); Taomo Mu, Irvine, CA (US)

(73) Assignee: Aetas Technology, Incorporated, Irvine, CA (US)

( * ) Notice: Subject to any disclaimer, the term of this patent is extended or adjusted under 35 U.S.C. 154(b) by 0 days.

(21) Appl. No.: 09/722,995

(22) Filed: Nov. 27, 2000

(51) Int. Cl.[7] ..... G03G 15/01; G03G 15/08

(52) U.S. Cl. ..... 399/223; 399/296; 430/42; 430/120

(58) Field of Search ..... 399/53, 222, 223, 399/231, 252, 296; 430/42, 120; 347/115

(56) References Cited

U.S. PATENT DOCUMENTS 5,541,029 A * 7/1996 Iwata et al. ..... 430/42 X
5,723,240 A * 3/1998 Allen ..... 430/120 X
5,828,933 A * 10/1998 Rees et al. ..... 399/223

FOREIGN PATENT DOCUMENTS

JP 04-371978 * 12/1992

* cited by examiner

*Primary Examiner*—Sophia S. Chen
(74) *Attorney, Agent, or Firm*—Sonnenschein Nath & Rosenthal

(57) ABSTRACT

An apparatus for efficiently transferring at least two subtractive color toner images simultaneously onto a substrate. The apparatus includes a photoreceptor, transfer charger, mechanism for placing the substrate between the photoreceptor and transfer charger, a plurality of print stations and a stabilizing charger unit. Each of the print stations include a charger unit, an exposure unit, and a developer unit for applying a respective color toner to the latent image formed by the exposure unit in conjunction with the charger unit upon the photoreceptor. Upon application to photoreceptor, each toner has an initial charge-to-mass ratio, which is subsequently increased to a saturated charge-to-mass ratio when the toner passes under the charger unit of a subsequent print station. Thus, the stabilizing charger unit substantially conforms the charge-to-mass ratio of the toner deposited by the last print station to the charge-to-mass ratio of the toner developed previously. This results in more homogeneous transfer characteristics for all toners. A similar method is also disclosed.

12 Claims, 3 Drawing Sheets

METHOD AND APPARATUS FOR STABILIZING THE CHARGE-TO-MASS RATIO OF VARIOUS TONER COMPONENTS IN A MULTI-TONER TONE-ON-TONE ELECTROPHOTOGRAPHIC DEVICE

FIELD OF THE INVENTION

The present invention relates to a color image forming apparatus such as an electrophotographic copier, printer or the like and, in particular, to an apparatus and method for stabilizing the charge-to-mass ratio of the various toner components in such a color imaging system.

BACKGROUND ART

Electrophotographic imaging (or xerography) is a well known method of copying or otherwise printing documents. In general, electrophotographic imaging uses a charge-retentive, photosensitive surface (known as a photoreceptor) that is initially charged uniformly. The photoreceptor is then exposed to a light image representation of a desired image that discharges specific areas of the photoreceptor surface creating a latent image. Dry toner powder is applied to the latent image, forming a developed image. This developed image is then transferred from the photoreceptor to a substrate (e.g. paper, transparency, and the like) generally by the use of electrostatic attraction between the charged toner particles and oppositely charged ions sprayed on the substrate by a transfer charger.

This electrophotographic process can be used to produce color images by repeating the above-described process for each color of toner used. However, in this tone-on-tone (also known as "image-on-image") color accumulation approach, recharging the photoreceptor between toner applications results in increasing the charge-to-mass ratio of any toner previously deposited on the photoreceptor until the toner reaches a saturated charge-to-mass ratio. Unfortunately, the last toner color applied is not subjected to any recharging; consequently it has a different charge-to-mass ratio than the other toner colors. Inasmuch as the charge-to-mass ratio of toner affects its transfer efficiency, image quality is likely to be adversely affected by this disparity in the charge-to-mass ratios.

While various prior art references disclose the use of a pretransfer charging corona to ensure that all of the toner particles have the same electrostatic polarity, none of those references acknowledge the problem of differing charge-to-mass ratios between toner particles of the same polarity. Still other electrophotographic processes including: Rees, U.S. Pat. Nos. 5,828,933 and 5,978,628 and Appel, U.S. Pat. No. 5,933,182, teach the use of a pretransfer erase lamp in addition to a corona charger to encourage uniform charging of the toner components. This approach adds additional cost and results in a lower overall charge-to-mass ratio, thus, requiring the generation of a higher electrostatic attraction to transfer the toner from photoreceptor to substrate.

In yet another prior art approach to tone-on-tone electrophotography a selective pretransfer charger for use in association with a tri-level, highlight electrophotography system that uses two wavelengths of light to discharge a uniformly charged photoreceptor surface to three electric charge levels (each level corresponding to the latent image of one toner color) is used. See Parker, U.S. Pat. No. 5,895,738. This electrophotographic approach is highly complex.

Thus, among other potential needs, a need exists for a method and apparatus for tone-on-tone electrophotography having toners of a higher, substantially uniform pretransfer charge-to-mass ratio.

SUMMARY OF THE DISCLOSURE

The present invention relates to a method and apparatus for efficiently transferring at least two subtractive color toner images simultaneously onto a substrate. The apparatus includes a photoreceptor (drum or belt), a transfer charger operably associated with the photoreceptor; a mechanism for placing the substrate between the photoreceptor and transfer charger; and a plurality of print station. Each of the print stations is operably associated with the photoreceptor to form a plurality of color images thereon in registration with one another to form a subtractive color image on the photoreceptor. Each print stations includes a charger unit, an exposure unit, and a developer unit for applying a respective color toner to the photoreceptor, while these print stations are preferably uniform to aid in maintenance of the unit.

Upon application of a color tone image to the photoreceptor each color images consists of toner having an initial charge-to-mass ratio. Essentially, an example is shown wherein each of charger units charges the photoreceptor to substantially the same potential and induces a saturated charge-to-mass ratio in any toner previously laid down on the photoreceptor. This saturated charge-to-mass ratio being significantly greater than said initial charge-to-mass ratio.

Consequently, the apparatus further includes a stabilizing charger unit, which substantially conforms the charge-to-mass ratio of the last applied toner to the previously applied toner before the composite color images are electrostaticlly attracted from the photoreceptor to the first substrate surface by operation of the transfer charger. In this manner, the apparatus ensures transfer rate uniformity, thus, leading to potentially improved image quality. The stabilizing charger unit includes a non-contact charging system, which may include a corona wire and may even be a corotron, scorotron and pin scorotron. In one example, the print station charger and stabilizing charger units are the same apparatus type.

The method for efficiently transferring a composite toner image having at least two subtractive color toner images simultaneously onto a substrate from a photoreceptor includes: (a) charging the photoreceptor to a desired potential; (b) forming a respective color latent image on the photoreceptor; (c) developing the respective color latent image with a respective color toner to form a respective color toner image with the respective color toner having an initial charge-to-mass ratio; (d) repeating steps (a) through (c) for each of the color toner images, including a last color toner image, that together completely form the composite toner image; (e) charging the color toner of the last toner image to the saturated charge-to-mass ratio; and (f) electrostatically transferring the composite toner image onto the substrate surface.

DETAILED DESCRIPTION OF THE PREFERRED EMBODIMENT

Figure 1:
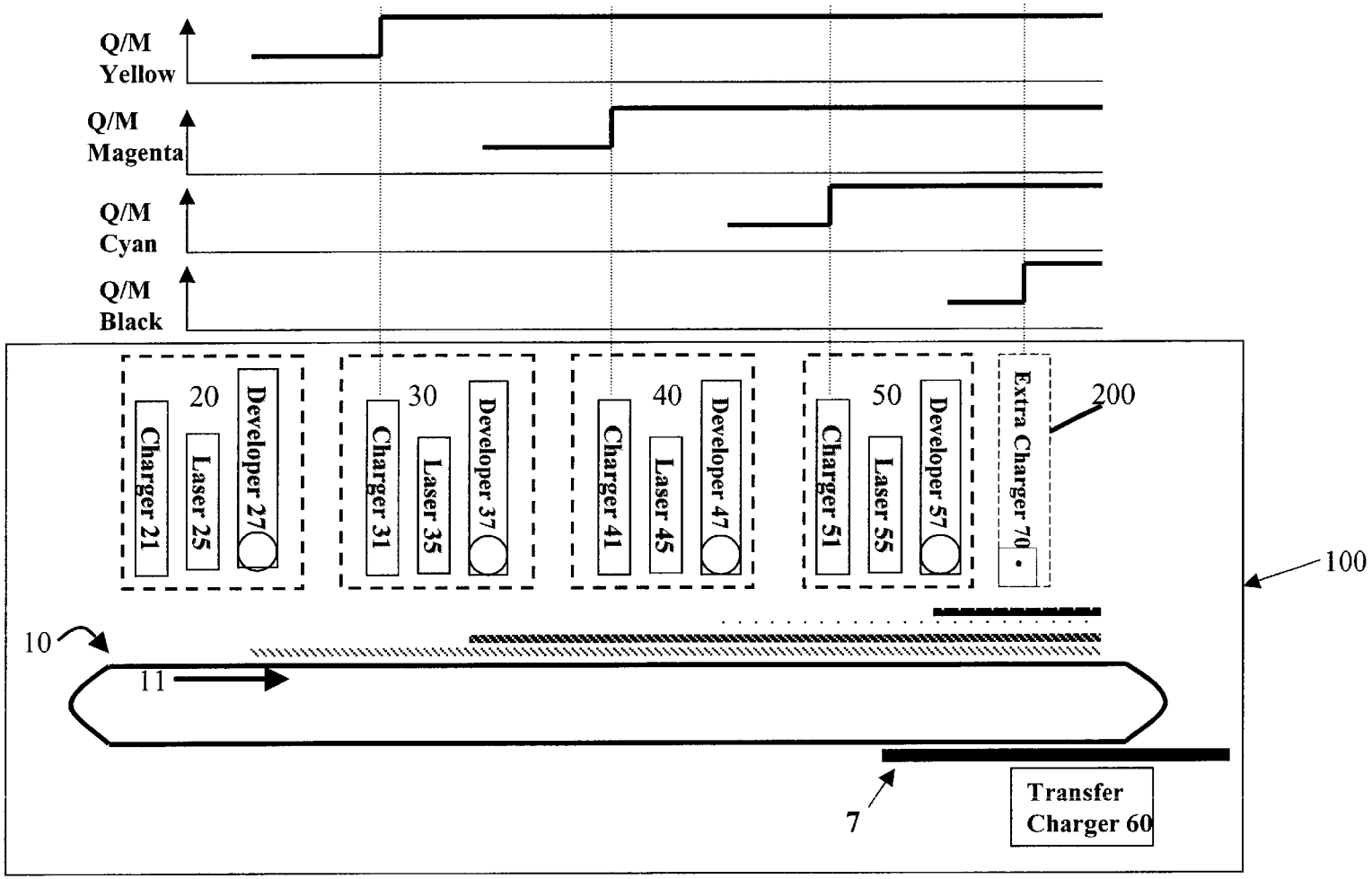
FIG. 1 of the drawings is a block diagram of a general case tone-on-tone electrophotographic apparatus incorporating one approach to the inventive concept disclosed herein with a graphical depiction of the charge-to-mass ratios versus time of various toner components applied by the electrophotographic apparatus.

While the present invention may be embodied in many different forms, there is shown in the drawings and discussed herein a few specific embodiments with the understanding that the present disclosure is to be considered only as an exemplification of the principles of the invention and is not intended to limit the invention to the embodiments illustrated.

FIG. 1 of the drawings depicts a general case of a tone-on-tone electrophotographic apparatus 100 that efficiently transfers at least two subtractive color toner images simultaneously onto a substrate, such as plain paper or transparency slides. Basically, as in most, if not all, tone-on-tone electrophotographic device, electrophotographic device 100 includes photoreceptor 10, a series of print stations 20, 30, 40 and 50, transfer charger 60, some means for placing the substrate between the photoreceptor and transfer charger (not shown) and some means for fixing the charged toner image on the substrate (not shown).

Photoreceptor 10 is schematically shown in FIG. 1 as comprising a belt-type photoreceptor. While a belt-type photoreceptor is shown in the drawing, it is also contemplated that other types of photoreceptors, such as a drum-type photoreceptor may be used. As would be understood by those of ordinary skill in the art, in the case of a belt-type photoreceptor, the belt would be positioned about two or more rollers: one roller serving as a drive roller and another serving as a tensioning roller. In most instances, the photoreceptor (belt or drum) will be driven by a motor (not shown) in the direction indicated by arrow 11. As the photoreceptor rotates, each part thereof will be brought into operable registration with the various components of the electrophotographic apparatus, including print stations 20, 30, 40 and 50, extra charger 200 and transfer charger 60. For purposes of this disclosure, we will focus on a portion of the photoreceptor as it passes from station to station, which we shall refer to as the image area.

Figure 2:
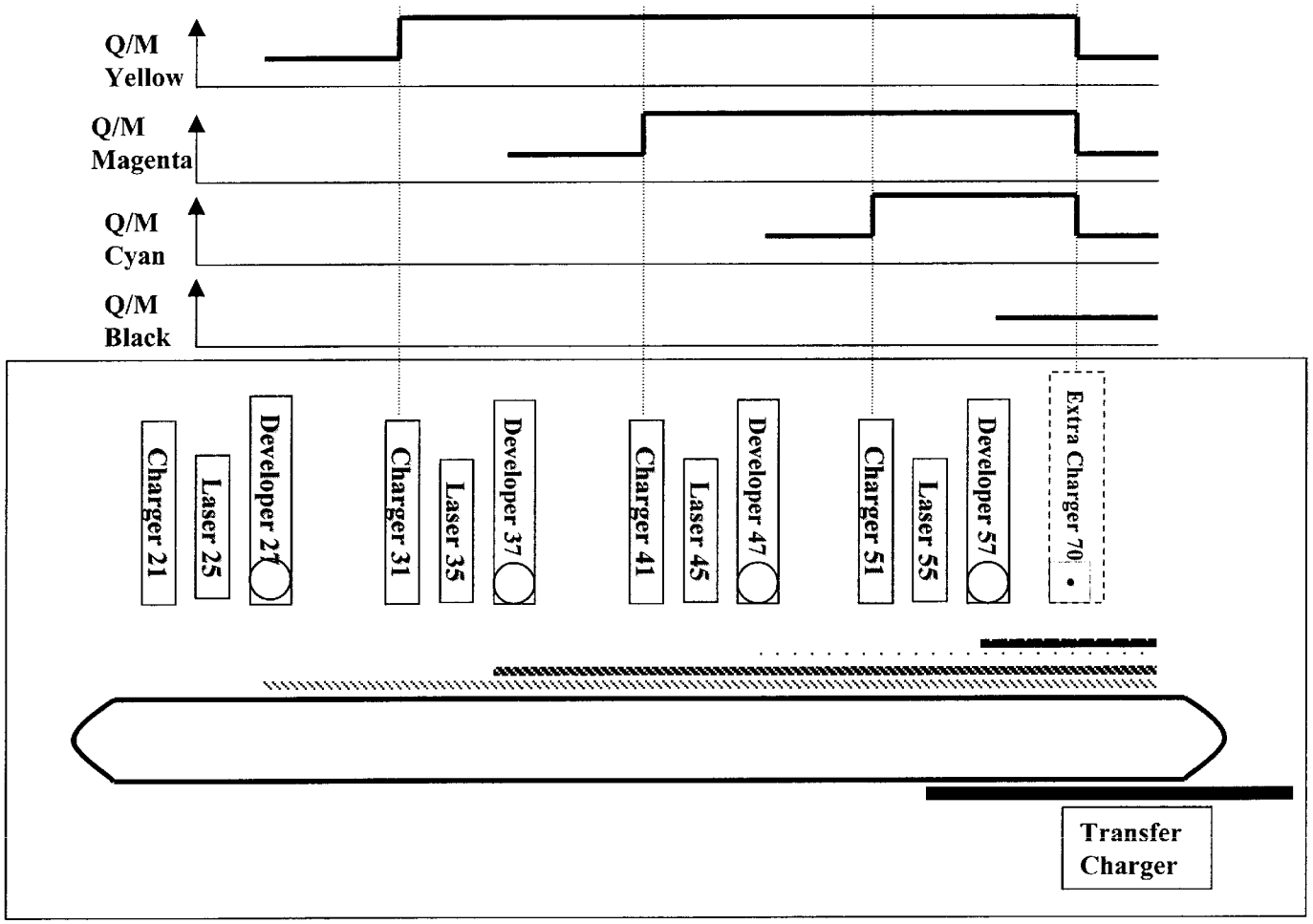
FIG. 2 of the drawings is a block diagram of a general case tone-on-tone electrophotographic apparatus incorporating a second approach to the inventive concept disclosed herein with a graphical depiction of the charge-to-mass ratios versus time of various toner components applied by the electrophotographic apparatus.

Each print station comprises three components: a charger, light exposure device and a developer. Thus, as shown in FIGS. 1 and 2, print station 20 includes charger 21, laser 25, and developer 27; print station 30 includes charger 31, laser 35, and developer 37; print station 40 includes charger 41, laser 45, and developer 47; and print station 50 includes charger 51, laser 55, and a developer 57. While uniformity between the print stations and their components would make servicing of the apparatus 100 simpler, such uniformity is not necessary to the present inventive concept. Still, the general concept of each print station is substantially the same. Thus, the operation and interaction of print station 20 with the image area of the photoreceptor shall be described with the understanding hat such explanation applies equally to each other print station.

Charger 21 of print station 20 charges the image area of the photoreceptor uniformly. Charger 21 can be an AC or DC corotron, scorotron, dicorotron, a discorotron, a pin scorotron or any other device capable of setting up a uniform electric field within the photoconductor which provides a surface potential of 700 volts. The charger of subsequent print stations 30, 40, 50 and 60 should charge the photoreceptor (and any incident toner) to the substantially the same voltage level as the voltage field generated by charger 21.

Laser 25 of print station 20 selectively exposes the photoreceptor to a modulated light causing the photoreceptor charge to dissipate wherever light falls. By controlling the laser beam and its scan path the latent image is created. In this case, laser 25, has created the latent image for the yellow toner. As would be understood to those of ordinary skill in the art, other methods and apparatuses for selectively exposing portions of the image area to create a latent image, such as laser or bar LED array are amongst the various light sources that could be used for this purpose.

Developer 27 of print station 20 provides a charged toner to the photoreceptor. This charge is generally imparted to the toner by tribocharging in a manner known in the art. For the most part, the developers used in tone-on-tone processes have no physical contact with the photoreceptor because such contact would disturb previously deposited toner. Print station 20, however, can make physical contact with the photoreceptor because, unlike the developers of the subsequent print stations 30, 40 and 50, print station 20 interacts with a toner-less image area because it is the first print station. Thus, while it may be desirable from a servicing standpoint to have uniform components across the print stations, such uniformity is not necessary to the present inventive concept.

The various toners which accumulate on the photoreceptor (as depicted in FIG. 1) are transferred from the photoreceptor 10 to substrate 7 by operation of transfer charger 60. As shown in FIG. 1, transfer charger 60 is operably associated with the photoreceptor such that a substrate—being fed by a drive means well known in the art—is placed between the photoreceptor and transfer charger. The transfer charger sprays ions—having a charge opposite to that of the toner—on the back of the substrate to attract the toner onto the substrate. The resulting image is later fixed on to the substrate by way of fuser or other fixing device (not shown).

Figure 3:
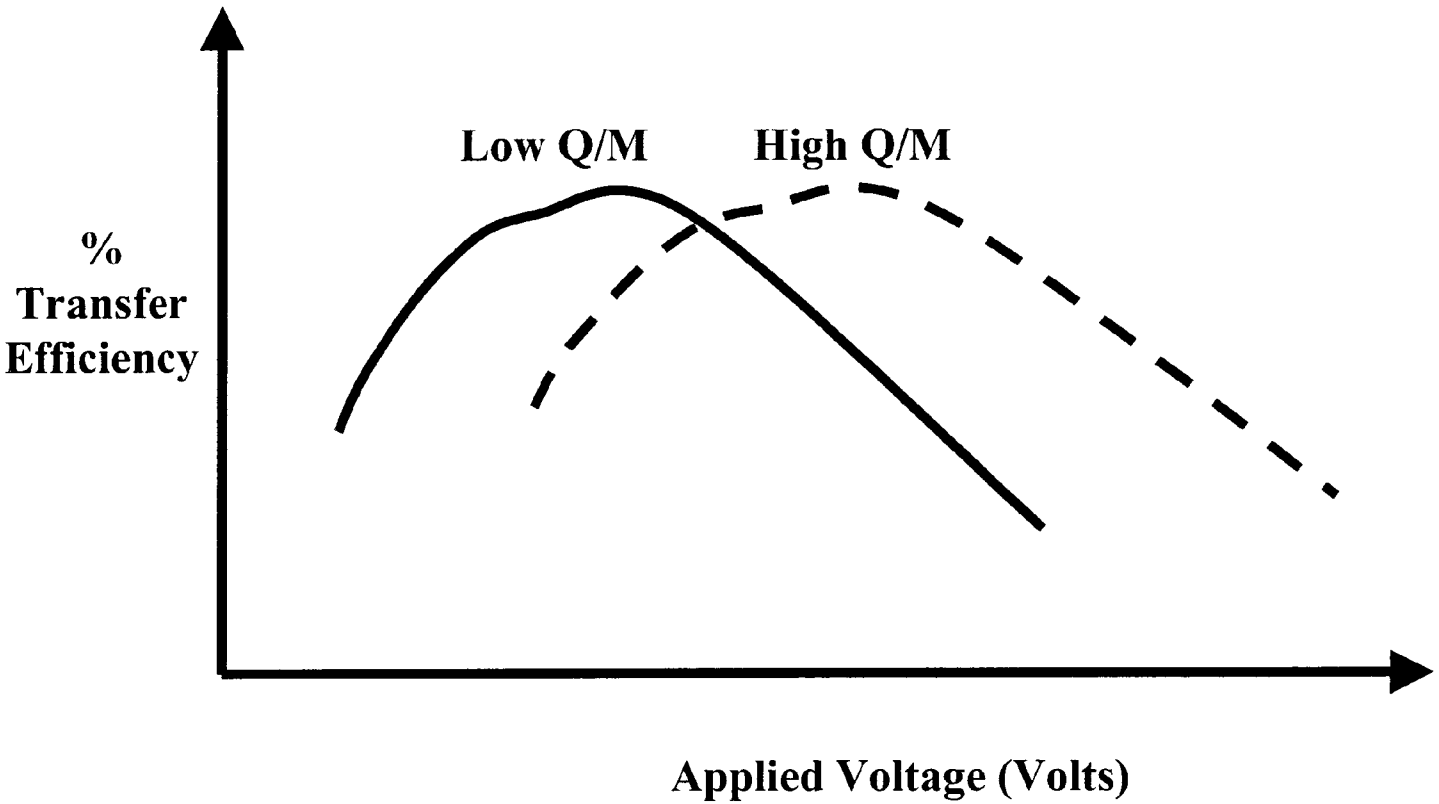
FIG. 3 of the drawings is a graphical depiction of the effect of a difference in the charge-to-mass ratio of various toner components.

As shown in the graphical depiction of the charge-to-mass ratios of the various toner components juxtaposed to the schematic portion of FIG. 1, based on the general configuration of a tone-on-tone electrophotographic apparatus, the last toner (black) toner would have had a lower charge-to-mass ratio than the three other toner components forming the composite image on photoreceptor 10. The effect on the transfer efficiency caused by such a difference in charge-to-mass ratios is graphically depicted in FIG. 3. As shown, this charge-to-mass ratio difference either necessitates generation of a higher electrical transfer field or the black toner will not transfer at the same rate as the other three toners. As a likely result, the composite image will deviate from its desired composition.

Each toner has an initial charge-to-mass ratio upon its initial application to the photoreceptor. Notably, these toner charge-to-mass ratios saturate once the toner is subjected to the subsequent electrical charging field generated by the charger of the next print station. As a result, the difference between the charge-to-mass ratio of the last applied toner and the other toners is known. Adding additional toner 200 can obviate this disparity in charge-to-mass ratios. The additional charger 200 may include a non-contact charging system having a corona wire 70. Additionally, charger 200 can be an AC or DC corotron, scoroton, dicorotron, discorotron, a pin scorotron or any other type of charging unit so long as it facilitates substantial uniformity between the charge-to-mass ratios of the four toner components. As shown in FIG. 1, this can be accomplished by increasing the last (black) toner. Alternatively, as shown in FIG. 2, the same result can be accomplished by decreasing the charge on the other toner components. In doing so, the transfer efficiency of the toner is substantially unified. Thus, solving a problem found in the prior art.

The foregoing description and drawings merely explain and illustrate the invention. Those of skill in the art who have the present disclosure before them will be able to make modifications and variations therein without departing from the scope of the present invention.

What is claimed is:

1. An apparatus for efficiently transferring at least two subtractive color toner images simultaneously onto a substrate, said apparatus comprising:

a photoreceptor;

a transfer charger operably associated with said photoreceptor;

said substrate being positioned substantially between said photoreceptor and said transfer charger;

a plurality of print stations including a last print station, each of said print stations operably associated with said photoreceptor to form a plurality of color images thereon, each of said print stations including a charger unit, an exposure unit, and a developer unit for applying a respective color toner to said photoreceptor, upon application to said photoreceptor each of said color images consisting of toner having a charge-to-mass ratio at an initial charge-to-mass ratio, each of said charger units charging said photoreceptor to substantially the same potential and inducing a saturated charge-to-mass ratio in said toner included in any previously formed ones of said color images, said saturated charge-to-mass ratio being significantly greater than said initial charge-to-mass ratio; and a stabilizing charger unit, substantially conforming said charge-to-mass ratio of said toner included in any previously formed color images before said color images are electrostatically attracted from said photoreceptor to said substrate by operation of said transfer charger.

2. The apparatus according to claim 1 wherein said stabilizing charger unit includes a noncontact charging system.

3. The apparatus according to claim 2 wherein said non-contact charging system includes a corona wire.

4. The apparatus according to claim 3 wherein said stabilizing charger unit is selected from the group consisting of corotron, scorotron, dicorotron, discorotron and pin scorotron.

5. The apparatus according to claim 1 wherein each of said plurality of print stations is the same.

6. An apparatus for efficiently transferring at least two subtractive color toner images simultaneously onto a substrate, said apparatus comprising:

a photoreceptor;

a transfer charge operably associated with said photoreceptor;

said substrate being positioned substantially between said photoreceptor and said transfer charger;

a first print station operably associated with said photoreceptor to form a first color image thereon, said first print station including a first charger unit, a first exposure unit, and a first developer unit for applying first color toner to said photoreceptor, said first color image consisting of toner having a charge-to-mass ratio at an initial charge-to-mass ratio;

a second print station operably associated with said photoreceptor to form a second color image thereon after formation of said first color image, said second print station including a second charger unit, a second exposure unit and a second developer unit, said first and second charger units both charging said photoreceptor to substantially the same potential, said second color image consisting of toner having a charge-to-mass ratio at substantially said initial charge-to-mass ratio while said first color image consists of toner having a saturated charge-to-mass ratio, said saturated charge-to-mass ratio being significantly greater than said initial charge-to-mass ratio, said saturated charge-to-mass ratio being induced in said toner of said first color image upon exposure of said photoreceptor and first color image by said second charger unit; and stabilizing charger unit, substantially conforming said charge-to-mass ratio of said toner included in any previously formed color images before said color images are electrostaticlly attracted from said photoreceptor to said substrate by operation of said transfer charger.

7. The apparatus according to claim 6 wherein said stabilizing charger unit includes a non-contact charging system.

8. The apparatus according to claim 7 wherein said non-contact charging system includes a corona wire.

9. The apparatus according to claim 8 wherein said stabilizing charger unit is selected from the group consisting of corotron, scorotron, dicorotron, discorotron and pin scorotron.

10. The apparatus according to claim 9 wherein said first, second and stabilizing charger units are the same.

11. The apparatus according to claim 6 wherein said first and second print stations are the same.

12. A method for efficiently transferring a composite toner image having at least two subtractive color toner image simultaneously onto a substrate from a photoreceptor, said method comprising:

(a) charging the photoreceptor to a desired potential resulting in any of the color toner disposed thereon to reach a saturated charge-to-mass ratio;

(b) forming a respective color latent image on the photoreceptor;

(c) developing the respective color latent image with a respective color toner to form a respective color toner image with the respective color toner having an initial charge-to-mass ratio;

(d) repeating steps (a) through (c) for each of the color toner images, including a last color toner image, that together completely form the composite toner image;

(e) charging the color toner of the last toner image to the saturated charge-to-mass ratio; and (f) electrostatically transferring the composite toner image onto the substrate.

* * * * *